US007776167B2

(12) United States Patent
Catteau et al.

(10) Patent No.: US 7,776,167 B2
(45) Date of Patent: Aug. 17, 2010

(54) EDGE-ON STRESS-RELIEF OF ALUMINUM PLATES

(75) Inventors: Frederic Catteau, Issoire (FR); Julien Boselli, Grenoble (FR)

(73) Assignee: Alcan Rhenalu, Inc., Paris (FR)

( * ) Notice: Subject to any disclaimer, the term of this patent is extended or adjusted under 35 U.S.C. 154(b) by 0 days.

(21) Appl. No.: 12/029,381

(22) Filed: Feb. 11, 2008

(65) Prior Publication Data

US 2008/0223492 A1 Sep. 18, 2008

Related U.S. Application Data

(62) Division of application No. 10/727,051, filed on Dec. 4, 2003, now abandoned.

(60) Provisional application No. 60/431,245, filed on Dec. 6, 2002.

(51) Int. Cl.
*C22F 1/04* (2006.01)

(52) U.S. Cl. ..... 148/695; 148/698; 148/701

(58) Field of Classification Search ..... 148/695, 148/698, 701

See application file for complete search history.

(56) References Cited

U.S. PATENT DOCUMENTS

| | | | | |
|---|---|---|---|---|
| 3,071,847 | A | 1/1963 | Paul | |
| 4,294,625 | A | 10/1981 | Hyatt et al. | |
| 6,159,315 | A | 12/2000 | Haszler et al. | |
| 6,406,567 | B1 * | 6/2002 | Haszler et al. | 148/415 |

FOREIGN PATENT DOCUMENTS

| | | | |
|---|---|---|---|
| EP | 1158068 | | 11/2001 |
| EP | 1158068 | A1 * | 11/2001 |
| GB | 924443 | | 12/1959 |
| JP | 61-119643 | A | 6/1986 |
| JP | 62-263954 | A | 11/1987 |

(Continued)

OTHER PUBLICATIONS

"Aluminum and Aluminum Alloys," ASM International, 1993, p. 317-320.

(Continued)

*Primary Examiner*—Roy King
*Assistant Examiner*—Janelle Morillo
(74) *Attorney, Agent, or Firm*—Baker, Donelson, Bearman, Caldwell & Berkowitz, PC

(57) ABSTRACT

In accordance with the present invention, there are provided methods for the manufacture of aluminum alloy plates having reduced levels of residual stress as well as plates and products employing such plates. Processes of the present invention involve providing a solution heat-treated and quenched aluminum alloy plate with a thickness of at least 5 inches, and stress relieving the plate by performing at least one compressing step at a total rate of 0.5 to 5% permanent set along the longest or second longest edge of the plate. In the method, the dimension of the plate where the compression step is performed is along the longest or second longest edge of the plate, which is preferably no less than twice and no more than eight times the thickness of the plate. In further accordance with the present invention, there are provided stress-relieved alloys and plates that are provided with superior $W_{tot}$ properties as well as reduced residual stress and heterogeneity values.

9 Claims, 13 Drawing Sheets

FOREIGN PATENT DOCUMENTS

| | | | |
|---|---|---|---|
| JP | 3-44452 | A | 2/1991 |
| JP | 4-325650 | A | 11/1992 |
| JP | 6-108210 | A | 4/1994 |
| JP | 8-246118 | A | 9/1996 |
| JP | 9-155647 | | 6/1997 |
| JP | 10-298692 | A | 11/1998 |
| JP | 11-50212 | A1 | 2/1999 |
| JP | 2002-285306 | A | 10/2002 |
| WO | 97/27343 | A1 | 7/1997 |

OTHER PUBLICATIONS

"Stress Relief in Aluminum Forgings," R.E. Kleint and Frank G. Janney, pub. in "Light Metal Age," Feb. 1958, pp. 14-21.
International Search Report, PCT/EP03/15022, dated Jun. 21, 2004.

* cited by examiner

| | | |
|---|---|---|
| Number of milling steps | = N - 2 | (from i=1 to N-2) |
| Number of thickness measurements | = N - 1 | (from i=1 to N-1) |
| Number of strain gage measurements | = N - 2 | (from i=2 to N-1) |
| Number of residual stress calculated = nb of step + remaining thickness stress calculated by stress equilibrium | = N - 1 | (from i=1 to N-1) |

EDGE-ON STRESS-RELIEF OF ALUMINUM PLATES

CROSS REFERENCE TO RELATED APPLICATIONS

The present application is a divisional application of U.S. application Ser. No. 10/727,051, filed Dec. 4, 2003, the entire disclosure of which is incorporated herein by reference, which claims the benefit of U.S. Provisional Application No. 60/431,245 filed Dec. 6, 2002, the entire disclosure of which is incorporated herein by reference.

BACKGROUND OF THE INVENTION

1. Field of the Invention

The present invention relates generally to a method of stress relieving thick aluminum alloy plates (particularly thick plates of at least about 5") exhibiting high mechanical properties, which allows reduction in the level of residual stress through the thickness of the plate, which in turn, reduces distortion after machining.

2. Description of Related Art

Thick plates are generally heat-treated to achieve high mechanical properties. Known processes include a solutionizing treatment at high temperature, followed by a cooling step, followed by a stress-relieving step. It is also known that stretching along the longest direction of a solution heat-treated and quenched aluminum plate may decrease the residual stress of the plate.

The article "Numerical Calculation of Residual-Stress Relaxation in Quenched Plates" by J. C. Boyer and M. Boivin (Material Science and Technology, October 1985, vol. 1, p. 786-753) includes theoretical calculations, which suggest that compression in the thickness direction of quenched plates in AA7075 alloy may decrease their residual stress. This is confirmed in the article, "A Finite Element Calculation of Residual Stresses After Quenching and Compression Stress Relieving of High Strength Aluminum Alloys Forgings," by P. Jeanmart, B. Dubost, J. Bouvaist and M. P. Charue (published in Conference Residual Stresses in Science and Technology, vol. 2, p. 587-594 (DGM 1987)) on the basis of experimental results obtained on test cylinders in AA7010 alloy, and in the article, "Relief of Residual Stress in a High-Strength Aluminum Alloy by Cold Working," by Y. Altschuler, T. Kaatz and B. Cina (published in "Mechanical Relaxation of Residual Stress", ASTM STP 993, L. Mordfin, Ed., American Society for Testing and Materials, Philadelphia, 1988, p. 19-29) on the basis of measurement on specimens compressed in the thickness direction.

Since the mid-1990s, quenched plate in 7xxx alloys that have been stress-relieved by compression in the thickness direction (followed by aging to the T 7452 temper) are being used for the manufacture of certain structural components in aircrafts (see the article "Residual Stress in 7050 Aluminum Alloy Restruck Forged Block," by T. Bains, published in the Proceedings of the 1$^{st}$ International Non-Ferrous Processing and Technology Conference, 10-12 Mar. 1997, St. Louis, p. 233-236). This process of compression in the thickness direction has been thoroughly investigated, especially in relation with subsequent aging treatments to T7542 temper. The influence of compression on aging response of AA7050 plate has been analyzed in a recent publication entitled, "On the Residual Stress Control in Aluminum Alloy 7050," by K. Escobar, B. Gonzalez, J. Ortiz, P. Nguyen, D. Bowden, J. Foyos, J. Ogren, E. W. Lee and O. S. Es-Said (Materials Science Forum, Vols. 396-402, p. 1235-1240 (2002)).

According to N. Yoshihara and Y. Hino's calculation and experimental evidence ("Removal Technique of Residual Stress in 7075 Aluminum Alloy", ICRS Residual Stress III, Science and Technology vol. 2, p. 1140-1145 (1992)), compression (T7353) is more effective to relieve residual stress in small 7075 alloy blocks than the so-called uphill quench process (referenced as T7353).

U.S. Pat. Nos. 6,159,315 and 6,406,567 B1 (both assigned to Corus Aluminum Walzprodukte GmbH) disclose methods of stress relieving solution heat-treated and quenched aluminum alloy plates that include a combination of a stress-relieving cold mechanical stretch and a stress-relieving cold-compression, the cold stretch being performed in the length direction, and the cold-compression being performed in the thickness direction.

SUMMARY OF THE INVENTION

In accordance with the present invention, there are provided aluminum alloy plates and methods for manufacturing aluminum alloy plates having reduced levels of residual stress. Methods of the present invention involve providing a solution heat-treated and quenched aluminum alloy plate with a thickness of preferably at least about 5 inches, and stress relieving the plate employing at least one compressing step at a total rate of 0.5 to 5% permanent set along a longest or second longest edge of the plate. In methods of the present invention, the dimension of the plate where the compression step is performed is preferably along the longest or second longest edge of the plate, which is preferably no less than twice and no more than eight times the thickness of the plate.

In further accordance with the present invention, there are provided stress-relieved alloys and plates that are provided with superior $W_{tot}$ properties as well as reduced residual stress and heterogeneity values.

The total average stored elastic energy $W_{tot}$, expressed in terms of kJ/m$^3$, is defined as:

$$W_{tot} = \frac{1}{2} \times \int\int_V \int \left( \sum_{i=1}^{3} \sum_{j=1}^{3} \sigma_{ij} \varepsilon_{ij} \right) dV$$

wherein $\sigma_{ij}$ is the stress tensor, and $\epsilon_{ij}$ the strain tensor.

Additional objects, features and advantages of the invention will be set forth in the description which follows, and in part, will be obvious from the description, or may be learned by practice of the invention. The objects, features and advantages of the invention may be realized and obtained by means of the instrumentalities and combination particularly pointed out in the appended claims.

BRIEF DESCRIPTION OF THE DRAWINGS

The accompanying drawings, which are incorporated in and constitute a part of the specification, illustrate a presently preferred embodiment of the invention, and, together with the general description given above and the detailed description of the preferred embodiment given below, serve to explain the principles of the invention.

FIG. 1 gives a schematic of stress-relieving by compression on L-T plane along S direction. FIG. 1(*a*) is a perspective view, while FIG. 1(*b*) is a cross section showing bites.

FIG. 2 shows a typical residual stress state ($\sigma_T$ in MPa) after stress-relieving by compression on L-T plane along S direction (model shown is a quarter of the actual plate as a result of symmetries in S and T directions).

FIG. 3 shows predicted through-thickness stress profiles in the T direction at mid-width of the plate after stress-relieving by compression on L-T plane along S direction.

FIG. 4 shows experimental through-thickness stress profiles in the T direction determined after stress-relieving by compression along S direction, and evaluated by the method described herein.

FIG. 5 shows how strain gauges are bonded on each side of the bar.

FIG. 6 shows the cutting of the bar in two halves and the measuring the strain of each gauge.

FIG. 7 shows the machining of the two ½ bar side by side.

FIG. 8 shows a schematic of edge-on stress-relieving.

FIG. 9 shows typical residual stress state ($\sigma_T$ in MPa) after stress-relieving by compression on S-L plane along T direction (model shown is a quarter of the actual plate as a result of symmetries in S and T directions).

FIG. 10 shows predicted through-thickness stress profiles in the T direction at mid-width of the plate after stress-relieving by compression on S-L plane along T direction.

FIG. 11 shows experimental through-thickness stress profiles in the T direction determined after edge-on stress-relieving by compression.

DETAILED DESCRIPTION OF A PREFERRED EMBODIMENT

It is desirable that thick plates in heat treatable aluminum alloys, especially those of the 2xxx, 6xxx and 7xxx series, present a level of residual stress as low as possible, if the plates are to be machined. Otherwise, deformation of the workpiece will occur during machining. Stretching and compression can be used, for example, to reduce residual stresses in such plates.

Figure 12:
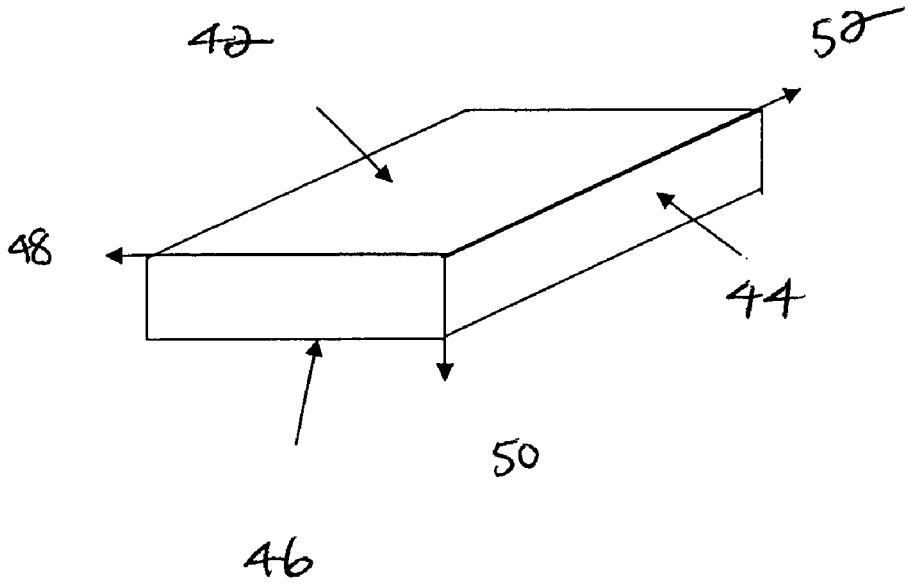
FIG. 12 shows the system of notation used throughout this specification.
Figure 13:
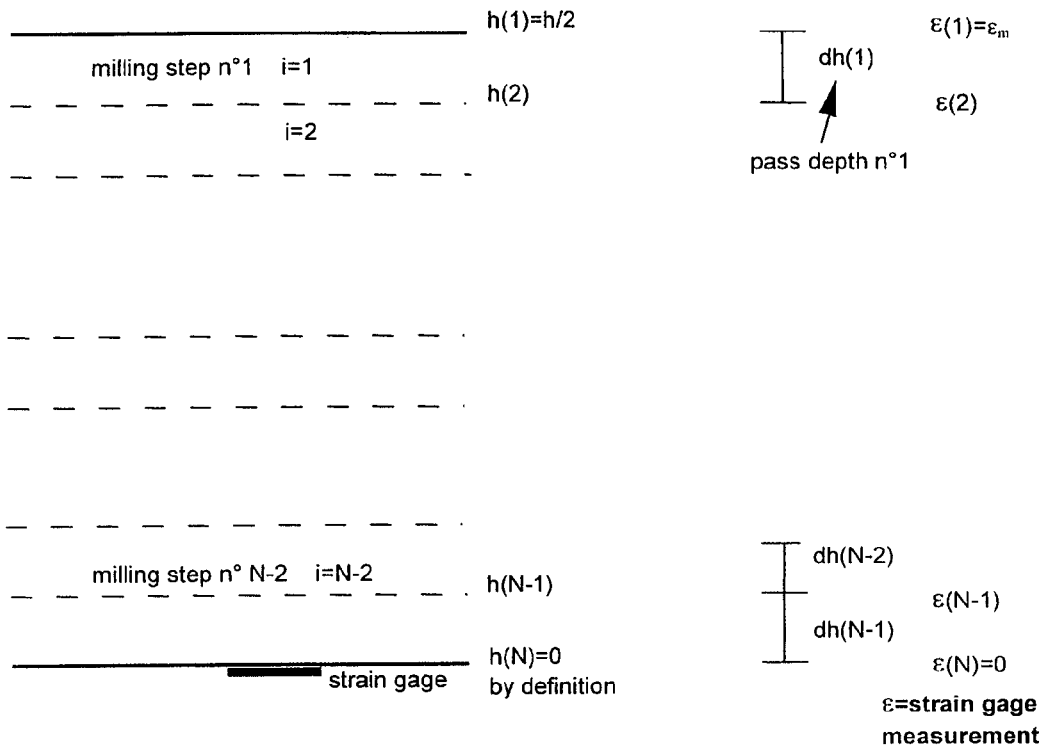
FIG. 13 schematically shows a suitable procedure for collecting strain data after milling.

For purposes of the present invention and description thereof, FIG. 12 provides an explanation of spatial indices described herein (i.e., "S direction", etc.). The indices shown in FIG. 12 are understandable to those of skill in art. As shown in FIG. 12, in a typical bar or plate 40, the L-T plane is 42, S-L plane is 44 and S-T plane is 46. The T direction is 48, S direction is shown as 50 and the L direction is depicted as 52 which is the rolling or forging direction. FIG. 13 schematically shows a suitable procedure for collecting strain data according to the present invention after milling.

Figure 1A:
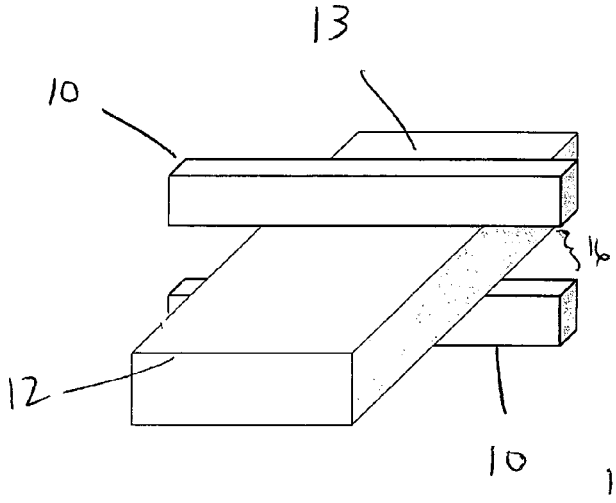
FIGS. 1-11 describe and depict features of embodiments of the present invention.
Figure 1B:
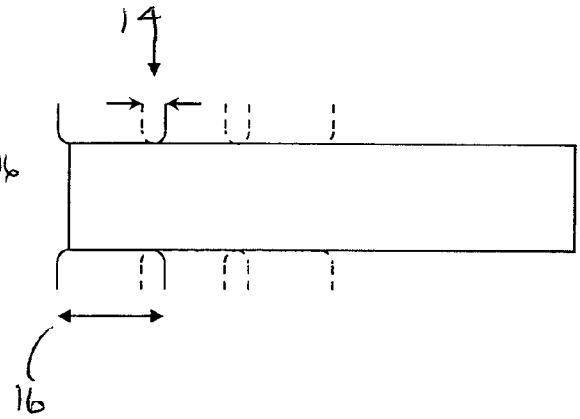
Figure 1(b) Prior Art

Industrially, compression according to prior art processes can be carried out on a large press using a set of dies 10 pressing along the shortest dimension 12 (i.e. the S direction) of a plate 13 as shown, for example, in FIGS. 1(*a*) and 1(*b*). Power limitations dictate that the compressed surface is relatively small in relation to the total plate surface, thus requiring a large number of successive compression steps. To ensure maximum stress-relief, an overlap 14 is included between each compression step to guarantee plastic deformation throughout the plate/block. Namely, the bite width 16 is often set back to some extent along the plate 13 with successive operations to include a degree of overlap 14. This method is referred to and known to those of skill in the art as standard short transverse stress-relief.

Figure 2:
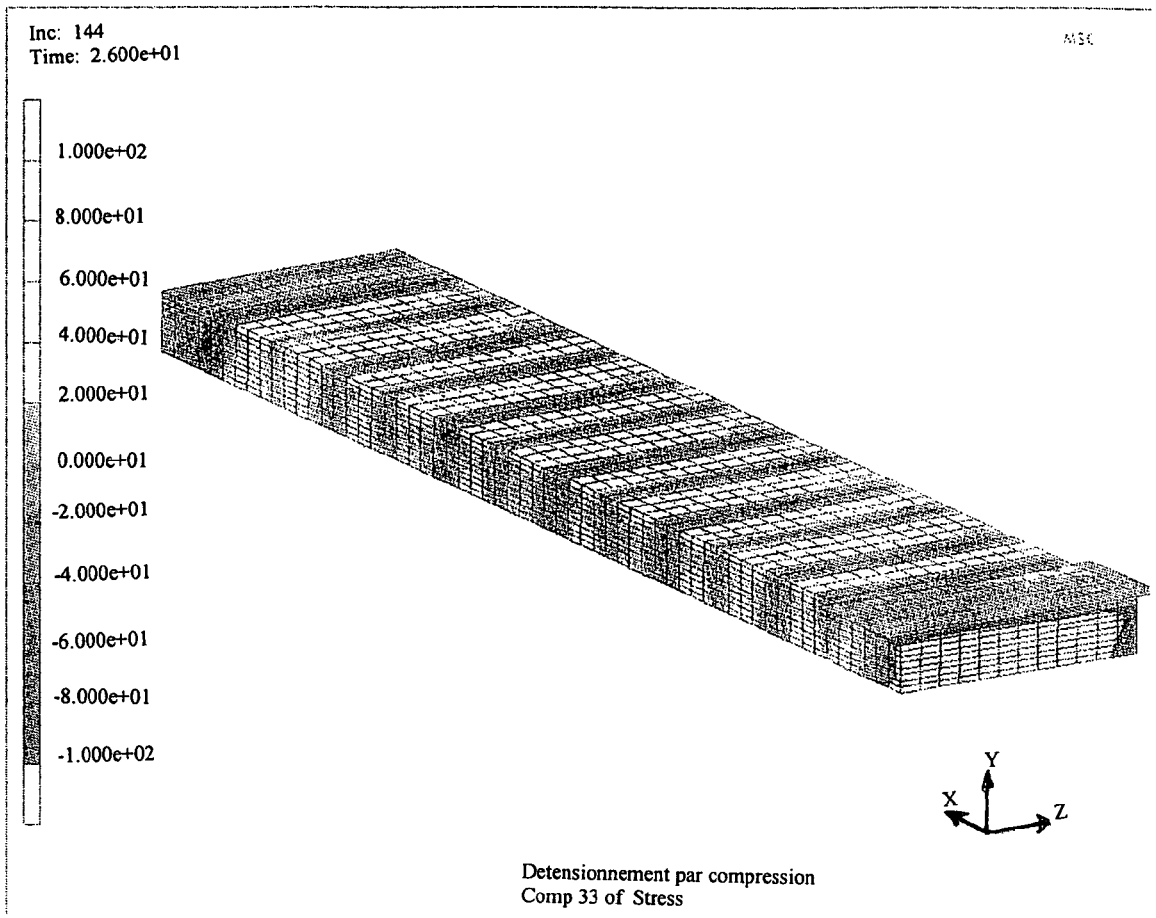
Figure 2 PRIOR ART
Figure 3:
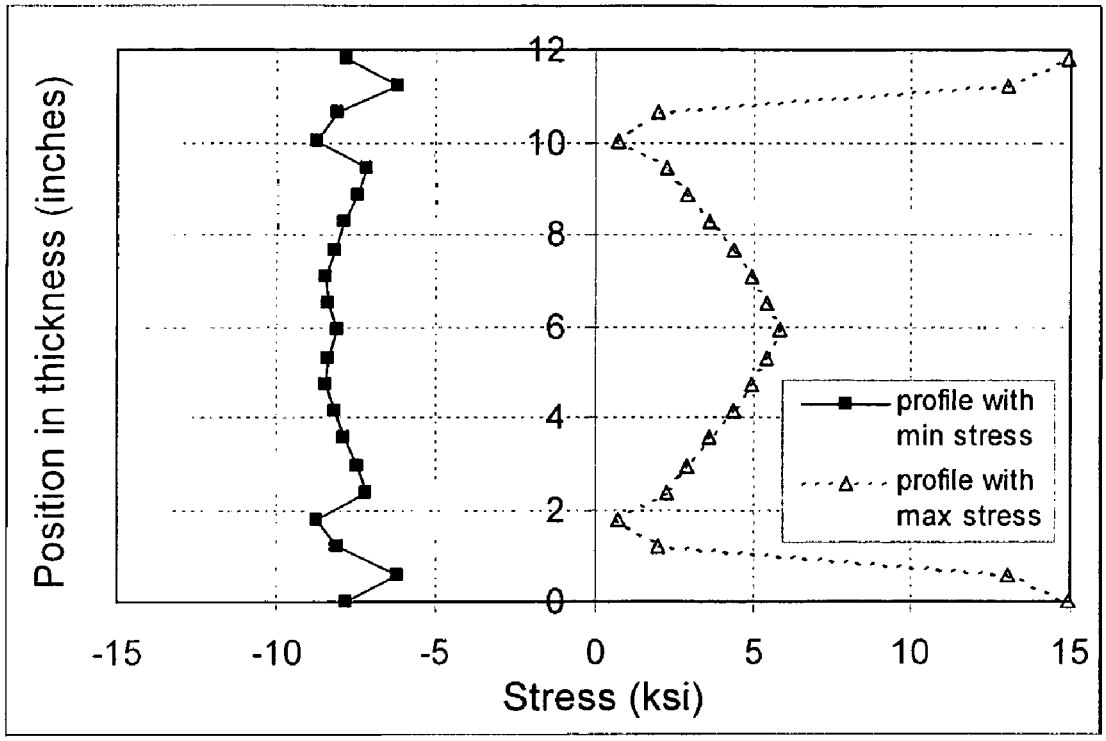

One drawback with this type of prior art process is that it results in non-uniform and generally high residual (or internal) stress levels. FIGS. 2 and 3 illustrate a 'typical' residual stress state obtained by numerical simulation after compression in the S direction of 2.5% for a 12"×47"×118" plate in 7xxx series aluminum alloy using the above-mentioned prior art process. By this prior art process, high residual stress levels are found in the regions of overlap 14 as well as in the center of the plate 12.

Figure 4:
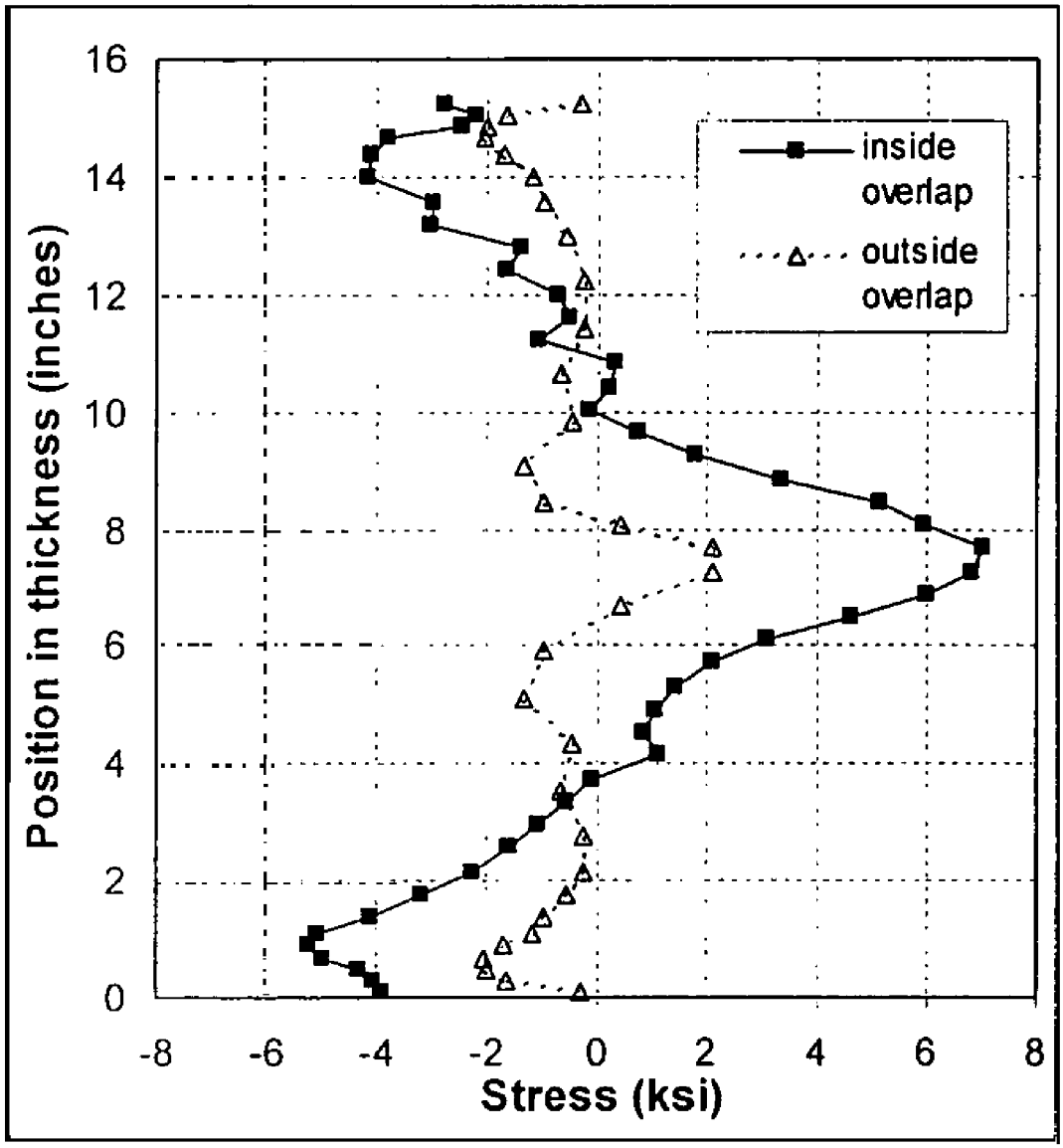

Such residual stresses can result in cracks initiating and propagating during cold compression itself or any other subsequent processing step such as aging or finishing. Furthermore, these high levels of residual stress can cause high levels of distortion and possibly cracks when machining the plate/block. These and other disadvantages associated with prior processes can be overcome in accordance with methods and plates of the instant invention. For example FIG. 4 shows experimental evidence of the residual stress state in a 16"×55"×64" plate made of 7010 aluminum alloy that was stress-relieved in S direction. Through-thickness stress profiles were obtained using the method for determining residual stress described below. The profiles of FIG. 4 were taken at various locations within the length of the plate. These profiles confirm the heterogeneity of the stress state of plates stress relieved according to the present invention.

Suitable representative methods for evaluating residual stresses in thick plates are described below.

Residual stresses in thick plates can be evaluated, for example, using a method described in "Development of New Alloy for Distortion Free Machined Aluminum Aircraft Components", F. Heymes, B. Commet, B. Dubost, P. Lassince, P. Lequeu, G. M. Raynaud, in 1$^{st}$ International Non-Ferrous Processing & Technology Conference, 10-12 Mar. 1997—Adams's Mark Hotel, St Louis, Mo., which is incorporated herein by reference.

This method applies mostly to stretched plates, for which the residual stress state can be reasonably considered as being biaxial with its two principal components in the L and T directions (i.e. no residual stress in the S direction), and such that the level of residual stress varies only in the S direction. This method is based on the evaluation of the residual stress in the L direction and the T direction, as measured in full thickness rectangular bars, which are cut from the plate along these directions. These bars are machined down the S direction step by step, and at each step the strain and/or deflection is measured, as well as the thickness of the machined bar. An advantageous and highly preferred way to measure strain is by using a strain gauge bound to a surface opposite to the machined surface at half length of the bar. Then two residual stress profiles in the L and in the T direction can be calculated.

Such a method generally needs to be modified, however, when dealing with thick plates (i.e., those from greater than about 5 inches in thickness, especially those from about 5—about 40 inches) that have been stress relieved by cold compression because the level of residual stress of such plates generally varies periodically in the L direction. Indeed, according to the prior art, the direction of compression is generally perpendicular to the L-T plane, such that a series of overlapping compression steps are often necessary to stress-relieve the whole plate. This makes it difficult to evaluate the stress level in a bar taken from such a plate in the L direction with the method described above. However, it is still possible to get an evaluation of the stress level of a bar sample taken in the T direction, provided that the width of the sample bar is small enough to enable stress relaxation in the L and S directions.

Therefore, the residual stress level in the forged plate can be evaluated by measuring the stress level in a full thickness bar cut in the T direction of the plate. The bar taken in the T direction is preferably cut as thin as possible, but is kept large enough not to impair the ease of machining, i.e., to have a width 22 from about 0.5—about 2.5 inches, more preferably from about 0.9—about 1.5 inches. A good compromise in some embodiments is to employ a bar that is approximately 1.2" wide. The bar should also be long enough to substantially minimize of even avoid any edge effect on the measurements. Most preferably, the length should be no less than three times the thickness of the plate.

Figure 5:
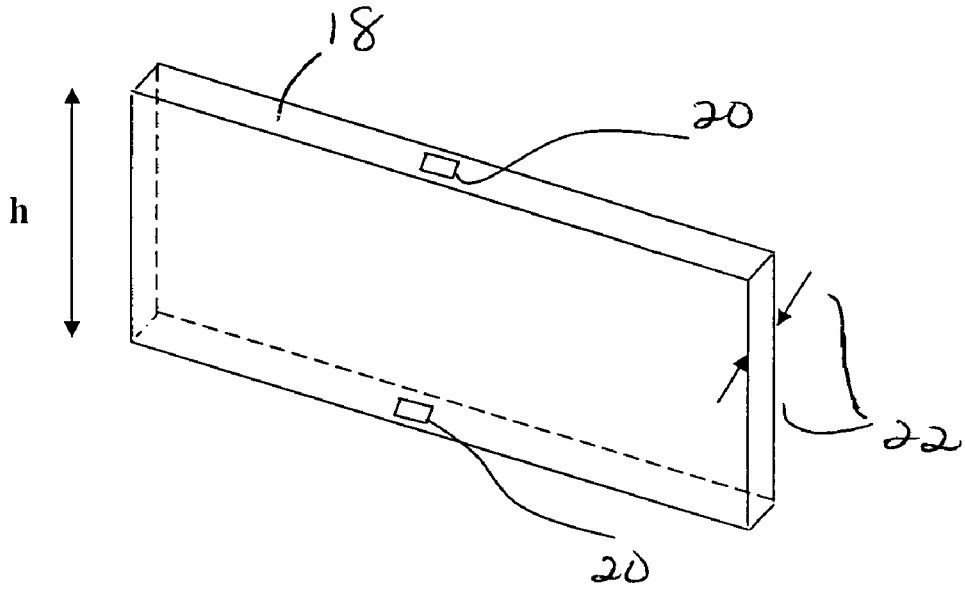

In the case of plates/blocks that are more than about 12" thick, strain variations resulting from the machining of full thickness bars may be so small that they are not easily picked up by the strain gauges. To solve this problem, a method was devised, whereby the initial full thickness bar is cut in two halves before machining. This also makes the manipulation of the bar easier and reduces the machining time. According to one useful method of the present invention, two unidirectional strain gauges with thermal expansion balancing 20 are bonded at approximately half length of the bar 18, having a dimension "h", on opposite faces of the bar (see FIG. 5).

Figure 6:
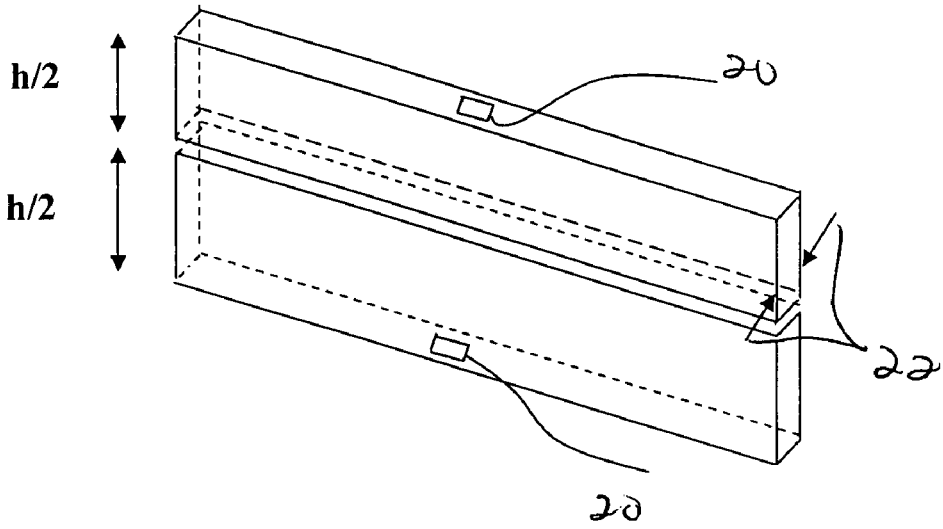
Figure 7:
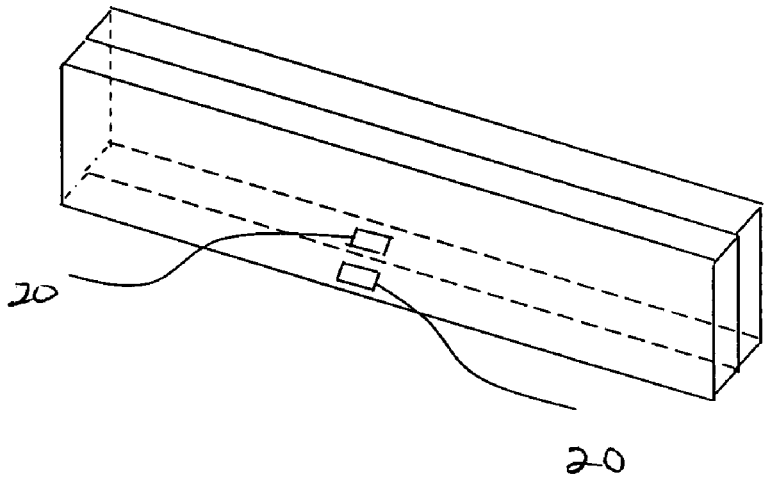

The gauges 20, once bound to the surface according to the gauge supplier's instructions, are preferably covered with an insulating varnish. The value read by each gauge 20 is then set to 0. The bar 18 is then cut in two halves to form two "h/2" portions, and the average relaxation strain $\epsilon_m$ is calculated by averaging the strains measured on the two gauges. The two half bars can then be machined side by side progressively (see FIGS. 6 and 7) if desired.

Measurements are advantageously performed after each machining pass. In order to obtain a sufficient number of points as a basis for the stress calculation, the number of passes can be set at any desired level, for example between about 10 and about 40, and typically between about 18 and about 25. To ensure high quality of machining, the milling pass depth is preferably no less than about 0.04" and can advantageously be up to about 0.8" according to some embodiments.

After every machining pass, each ½ bar is unclamped from the vice, and a stabilization time is allowed before the strain measurement is made, so as to allow for homogeneous temperature distribution in the bar after machining.

At each step i, the thickness h(i) of each ½ bar and the strain $\epsilon$(i) on each ½ bar, as given by the gauges after milling, are collected. FIG. 13 schematically shows a suitable procedure for collecting these data.

This data allows a calculation to be made of the residual stress profile in the bar in the form of $\sigma_{1/2bar}(i)T$, corresponding to the average stress in the layer removed during step i, as given by the following formulas:

For $i = 1$ to $N - 1$ $$\sigma_{1/2\,bar}(i)_T = -E\frac{(\varepsilon(i+1)-\varepsilon(i))h(i+1)^2}{[h(i)-h(i+1)][3h(i)-h(i+1)]} - S(i)_T$$

with:

$$S(i)_T = E\sum_{k=1}^{i-1}(\varepsilon(k+1)-\varepsilon(k))\left[1-\frac{3h(k)(h(i)+h(i+1))}{(3h(k)-h(k+1))h(k+1)}\right]$$

E being the Young's modulus of the metal plate.

The residual stress in the full bar can be derived easily from the residual stress in each ½ bar by using the following formula:

$$\sigma_{Tbar}=\sigma_{1/2bar}(i)_T-\sigma_{fl}(i),$$

where $\sigma_T$(i) is the bending stress in each ½ bar, resulting from mechanical equilibrium.

$\sigma_{fl}$(i) can be obtained, using classical beam calculation principles, with the hypothesis that the through-thickness sum of the residual stresses in each ½ bar is equal to zero prior to cutting. It is then straightforward to obtain the following formula:

$$\sigma_{fl}(i)=E\epsilon_m[1-4(h(i)/h)]$$

Finally, the elastic energy stored in the bar can be calculated from the residual stress values using the following formulas:

$$W_{Tbar}(\text{kJ/m}^3) = \frac{500}{Eh}\sum_{i=1}^{N-1}\sigma_{Tbar}^2(i)$$

Figure 8:
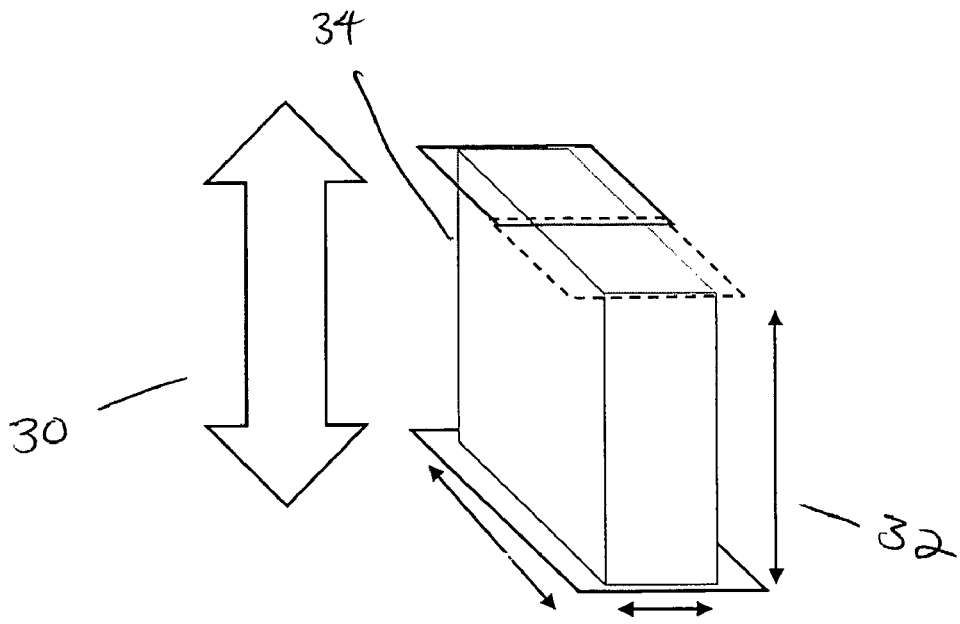

A novel method is instantly proposed herein to stress-relieve plates and/or blocks by compression that permits and can in some cases even ensure drastically reduced levels of residual stress. The term "plate" and "block" are both used here interchangeably to refer to products that can be compression treated according to methods of the present invention. The present method involves, inter alia, preferably compressing with a permanent set of 0.5 to 5% along the L or T direction 32 of an aluminum alloy plate or block 34, i.e. pressing along the longest or second longest edge of the plate or block as shown, for example, in FIG. 8. This method, referred to herein as "edge-on stress relief," is applicable to plates or blocks that are advantageously between about 5" and about 40" thick, and the length of the plate or block in the direction of compression (loading) is preferably no less than twice and no more than eight times the thickness of the plate or block. By significantly reducing the surface area of the plate/block 34 to be compressed compared to stress-relieving in the S direction described above, the number of compression steps and hence number of overlaps can be greatly reduced (typically 2 or 3 on a 20,000 ton press). The efficiency of stress-relieving, measured in terms of total stored elastic energy $W_{tot}$, is such that $W_{tot}$ levels after compression are often 50% or less when compared to standard short-transverse stress-relieving using similar compression loads.

Figure 9:
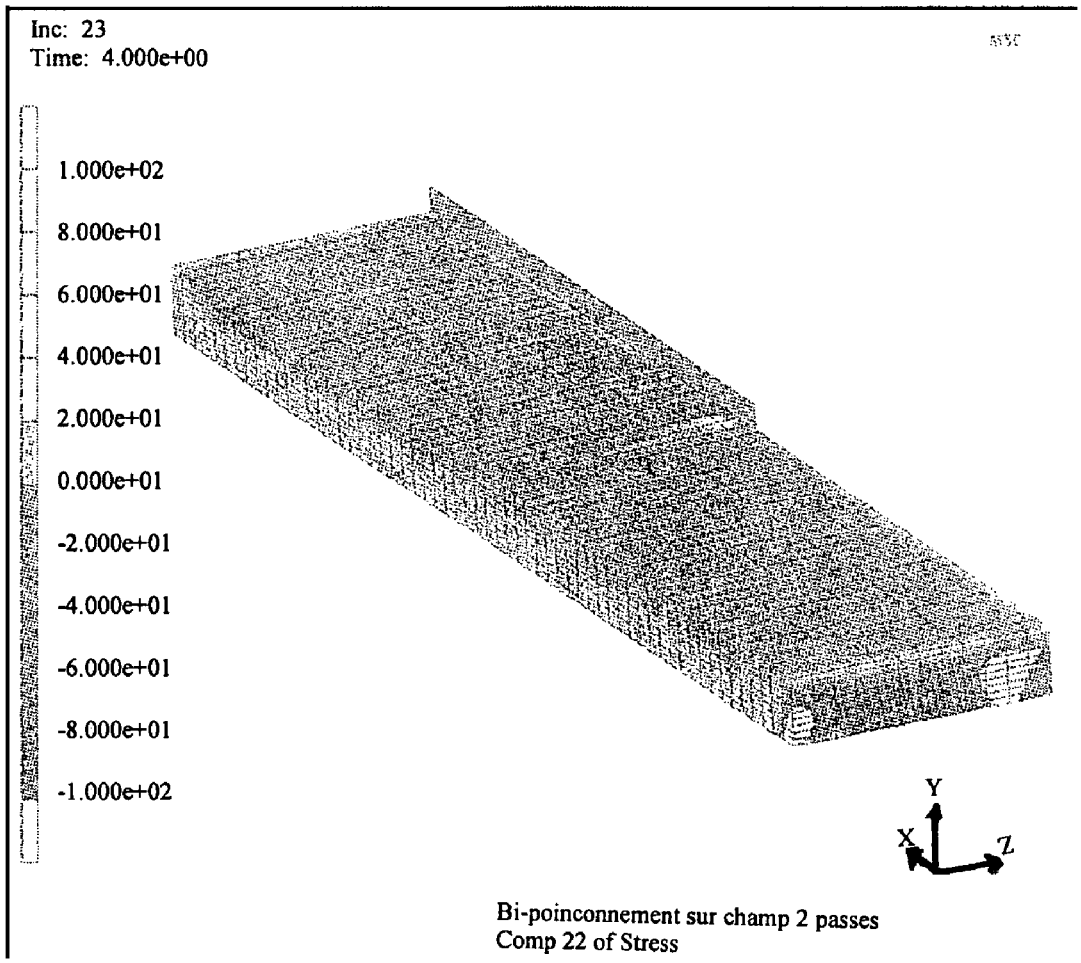
Figure 10:
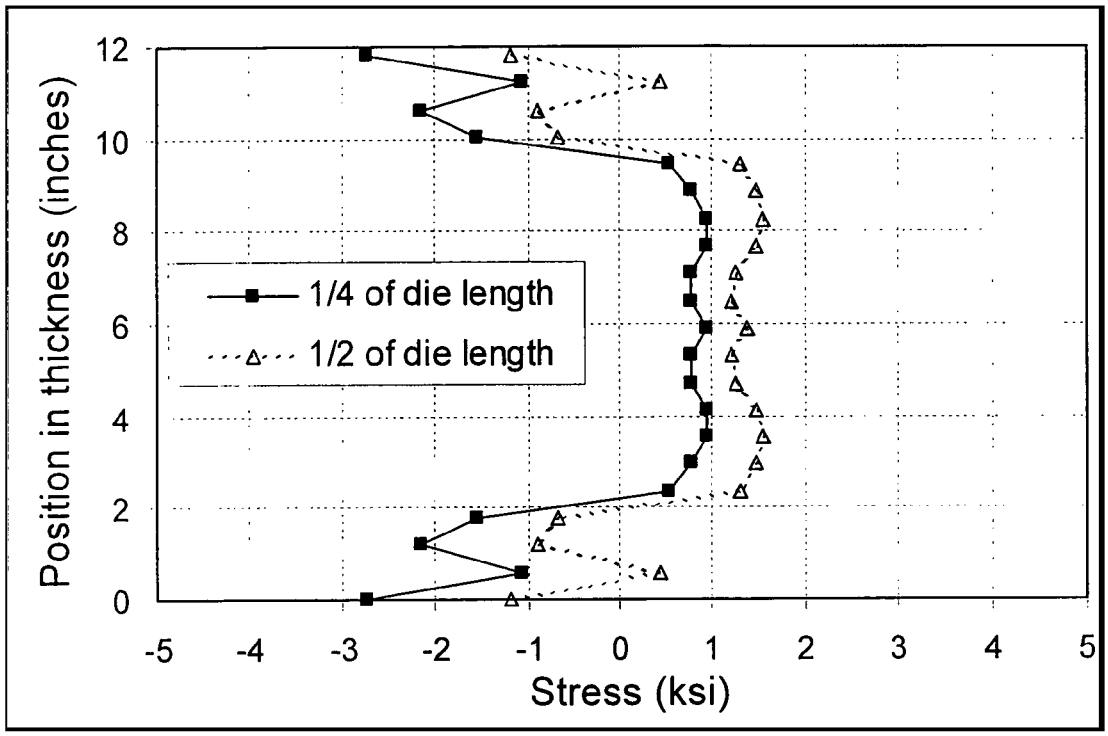

FIGS. 9 and 10 illustrate a 'typical' residual stress state obtained from numerical simulation after edge-on compression of 2.5% for a 12"×47"×118" plate in 7xxx series aluminum alloy according to an above-described inventive method. In comparison to FIGS. 5 and 6, it may be seen that both the heterogeneity and the average level of the residual stress state are dramatically reduced.

A further comparison of residual stress levels can be made in terms of total average stored elastic energy ($W_{tot}$) predicted by numerical simulation, expressed in terms of kJ/m$^3$.

The total average stored elastic energy $W_{tot}$, expressed in terms of kJ/m$^3$, is defined as:

$$W_{tot} = \frac{1}{2}\times\int\int_V\int\left(\sum_{i=1}^{3}\sum_{j=1}^{3}\sigma_{ij}\varepsilon_{ij}\right)dV$$

wherein $\sigma_{ij}$ is the stress tensor, and $\epsilon_{ij}$ the strain tensor.

For the same 12" thick plate in a 7xxx series aluminum alloy under identical compression rates of 2.5%, the compression along the S direction according to the prior art method of stress relief described supra resulted in a $W_{tot}$ of 65 kJ/m$^3$ whereas the edge-on compression of the present invention resulted in a $W_{tot}$ of 14 kJ/m$^3$. Average levels of residual stresses were therefore reduced by a factor of 4. This was surprising and completely unexpected.

Figure 11:
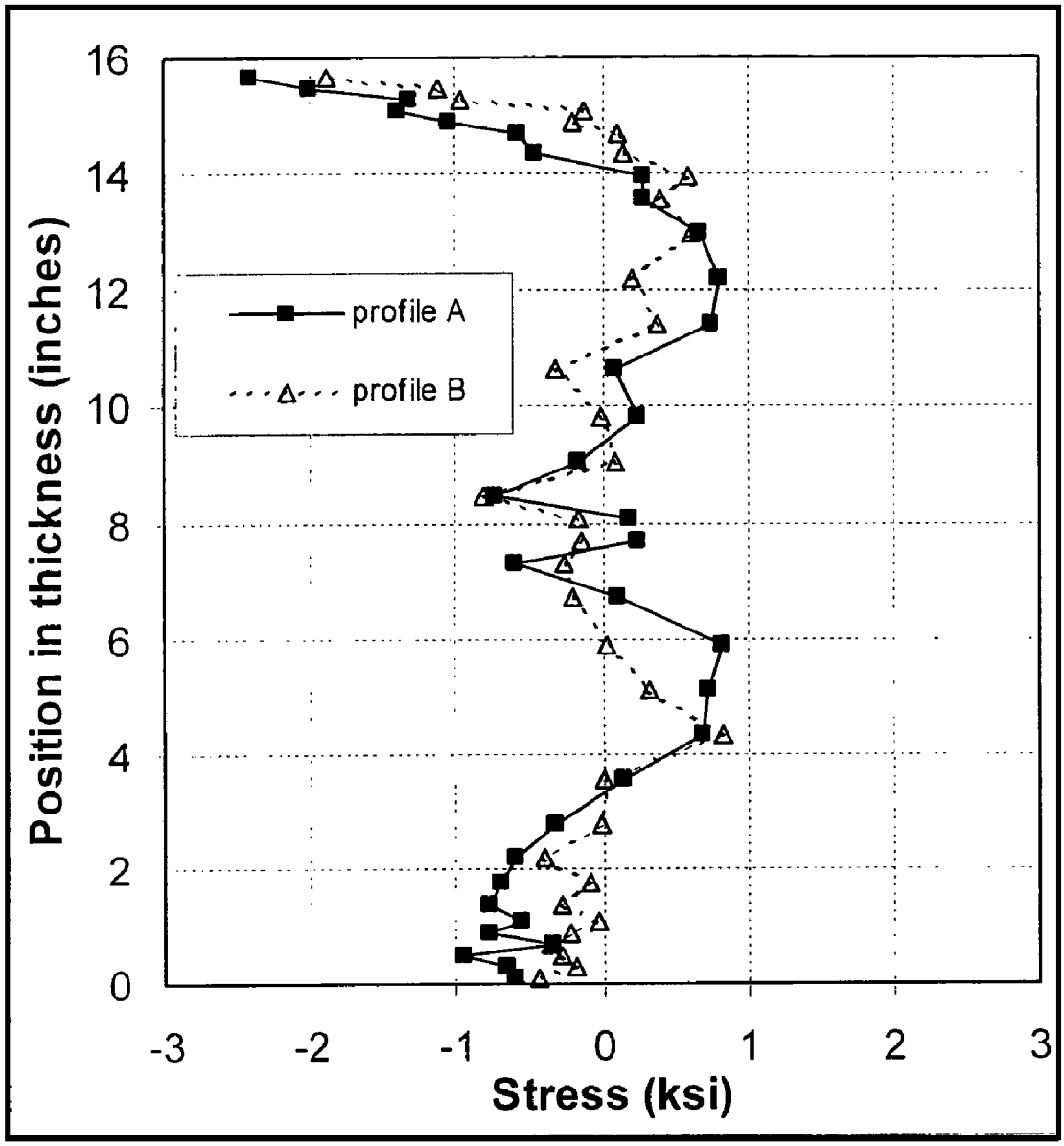

FIG. 11 shows experimental evidence that was conducted of the residual stress state in a 16"×45"×46" block made of 7010 aluminum alloy that was stress-relieved by a method according to the present invention such that the direction of compression was parallel to the longest dimension of the block as shown in FIG. 11. Through-thickness residual stress profiles were significantly reduced and tended to be less dependent on location in comparison to those observed in blocks stress-relieved by a standard method (see FIG. 7) using at least four at least partially overlapping compression steps.

A further comparison can be made in terms of stored elastic energy $W_{Tbar}$ in the direction that has been characterized (this represents only a fraction of the total elastic energy but is a useful indicator for comparison purposes). $W_{Tbar}$ values obtained for the two experimental stress profiles shown in FIG. 7 were 3.5 and 0.37 kJ/m$^3$ inside and outside of the overlap region respectively. In comparison, $W_{Tbar}$ values obtained experimentally on the same block stress relieved in one compression step along the longest dimension of the block on two different test bars were 0.06 and 0.14 kJ/m$^3$ respectively (see the profiles shown in FIG. 11). This result confirms the drastically reduced levels of residual stresses obtained by a method according to the present invention.

Products according to the present invention can be used for any desired purpose where stress relieved materials would be useful or beneficial including for manufacturing injection molds, such as molds for plastics and rubber, for the manufacture of blow molds and molds for rotomolding, for the manufacture of machined mechanical workpieces, as well as spars for aircrafts, as well as many other applications, some of which might be unforeseeable at the present time.

The present invention is particularly advantageous for use with thick plates with a length L and a width W such that L×W>1 m$^2$, or even >2 m$^2$.

Additional advantages, features and modifications will readily occur to those skilled in the art. Therefore, the invention in its broader aspects is not limited to the specific details, and representative devices, shown and described herein. Accordingly, various modifications may be made without departing from the spirit or scope of the general inventive concept as defined by the appended claims and their equivalents.

As used herein and in the following claims, articles such as "the", "a" and "an" can connote the singular or plural.

All documents referred to herein are specifically incorporated herein by reference in their entireties.

What is claimed is:

1. A method for stress relieving an aluminum alloy plate having a reduced level of residual stress, said method consisting of a) providing a solution heat-treated and quenched aluminum alloy plate having an initial thickness at a predetermined location of from about 5 inches to about 40 inches, and having a longest edge and optionally a second longest edge, b) stress relieving said plate by compressing the plate at a total rate from about 0.5% to about 5% permanent set along said longest or said second longest edge thereof, wherein the length of the compressed edge of the plate is no less than twice and no more than eight times said initial thickness.

2. A method according to claim 1, wherein said plate comprises an alloy of the series 2xxx, 6xxx or 7xxx.

3. A method according to claim 1, wherein said plate has a thickness of less than 40 inches.

4. A method according to claim 1, wherein said plate has a thickness between 10 and 30 inches.

5. A method according to claim 1, wherein prior to solution heat-treating and quenching said plate has been subjected to rolling and/or forging.

6. A method according to claim 1, wherein said compressing is performed in up to three steps with at least partial overlap of compressed areas.

7. A method according to claim 1, wherein said compressing is performed at a temperature of less than 80° C.

8. A method according to claim 1, wherein said compressing is performed at a temperature of less than 40° C.

9. A method of claim 1, wherein said initial thickness is substantially uniform throughout said plate.

* * * * *